United States Patent [19]

Bräuning

[11] Patent Number: 4,626,029

[45] Date of Patent: Dec. 2, 1986

[54] WORK CHAIR

[75] Inventor: Egon Bräuning, Weil am Rhein, Fed. Rep. of Germany

[73] Assignee: Protoned B.V., Amsterdam, Netherlands

[21] Appl. No.: 816,680

[22] Filed: Jan. 3, 1986

Related U.S. Application Data

[63] Continuation of Ser. No. 541,112, Oct. 12, 1983, abandoned.

[30] Foreign Application Priority Data

Oct. 21, 1982 [CH] Switzerland ..... 6131/82

[51] Int. Cl.[4] ..... A47C 1/024

[52] U.S. Cl. ..... 297/367; 297/369; 297/DIG. 2

[58] Field of Search ..... 297/355, 366–369, 297/292, 300, 455, DIG. 2

[56] References Cited

U.S. PATENT DOCUMENTS 412,617 10/1889 Hogan ..... 297/369
2,310,476 2/1943 Todd ..... 297/367 X
4,270,797 6/1981 Brauning ..... 297/300
4,408,800 10/1983 Knapp ..... 297/300 X

FOREIGN PATENT DOCUMENTS 223979 7/1959 Australia ..... 297/369
32839 7/1981 European Pat. Off. ..... 297/DIG. 2
2338142 3/1975 Fed. Rep. of Germany ..... 297/355

*Primary Examiner*—William E. Lyddane
*Assistant Examiner*—Peter R. Brown
*Attorney, Agent, or Firm*—Ladas & Parry

[57] ABSTRACT

The work chair is provided with a backrest support (13) which is connected movably to the seat shell (4) or respectively to a base plate (10) stiffening the latter, for the purpose of individual adjustment of inclination, and is flexible in terms of bending along its vertical extension and the contour curve of which, under load, essentially approximates to the curve of the human spinal column. The inclination of the backrest can be fixed by means of a locking arrangement (14) which consists essentially of a pawl (16) which is spring-loaded (20) and of an engagement toothing (17) provided at the lower end of the backrest support (13).

4 Claims, 2 Drawing Figures

WORK CHAIR

Figure 1:
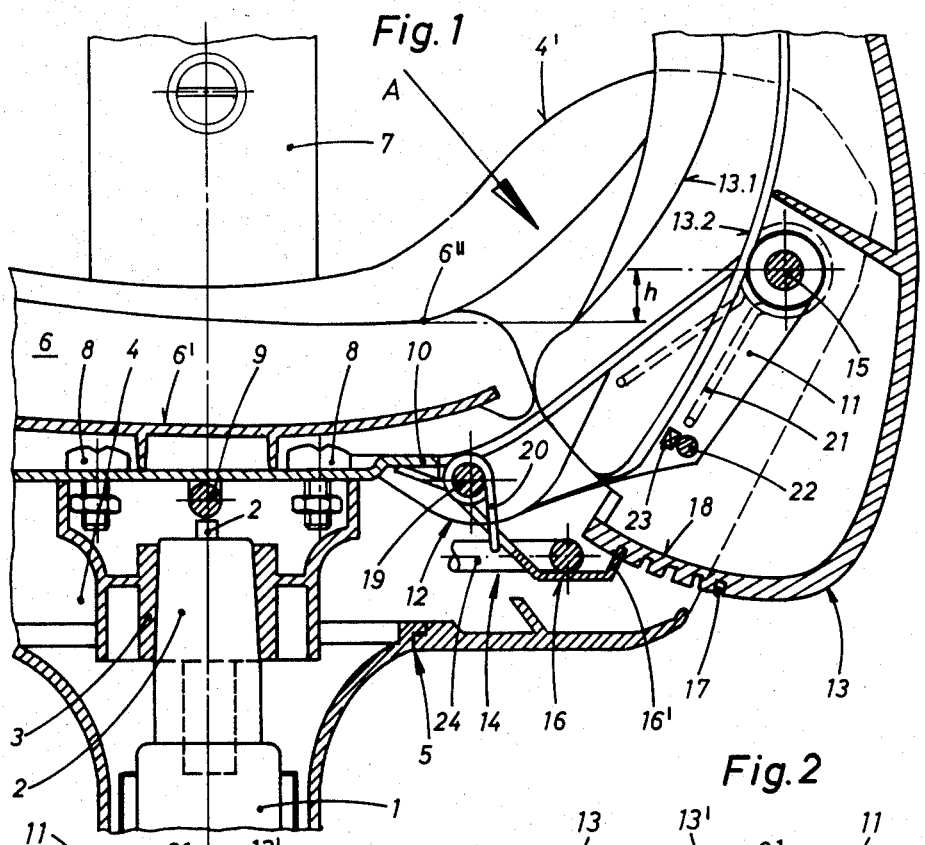

This is a continuation of co-pending application Ser. No. 541,112 filed on Oct. 12, 1983, abandoned.

The present invention relates to a work chair.

It is known to provide work chairs having a fixed seat shell with a backrest, the bending line of which is intended, under the load exerted by the user, to approximate as closely as possible to the natural curve of the human spinal column. Chairs of this type are provided, in the transitional region between the seat shell and the backrest or backrest support, with a relatively stiff buttock support which is intended to give secure guidance to the user's body precisely in this region. To achieve the desired bending line of the backrest, the chairs are appropriately produced in one piece from a highly stress-resistant plastic.

It is not difficult, admittedly, to match the desired bending line, particularly in the upper part of the backrest, with good approximation to the natural curve of the human spinal column. It is also possible to design the shouder rest at the upper end of the backrest in such a way that sufficient sitting comfort can be offered. However, a disadvantage is that the transition between the seat shell and the backrest, coming in the region of the buttock support, has to be provided with both transverse and longitudinal stiffening means, to allow the backrest to be connected in a dimensionally stable manner. But these measures limit the range of inclination of the back support or backrest which can be obtained, because its upper part cannot be made as "soft" as desired for reasons of strength.

The object of the present invention is, therefore, to propose a work chair of the type mentioned in the introduction, in which the articulated connection between the seat shell and the backrest is located in the region of the buttock support, and to design the components on the seat shell and on the backrest support, which make it possible to change the inclination, in such a way that a stable lockable articulated connection can be achieved by means of simple components which can be integrated in the chair construction.

An advantage of the solution according to the invention is that the back support, and consequently the position of the backrest and the shape of the buttock support, can easily be adjusted within a relatively wide range by means of a simple adjusting mechanism so as to meet individual requirements at the workplace.

Figure 2:
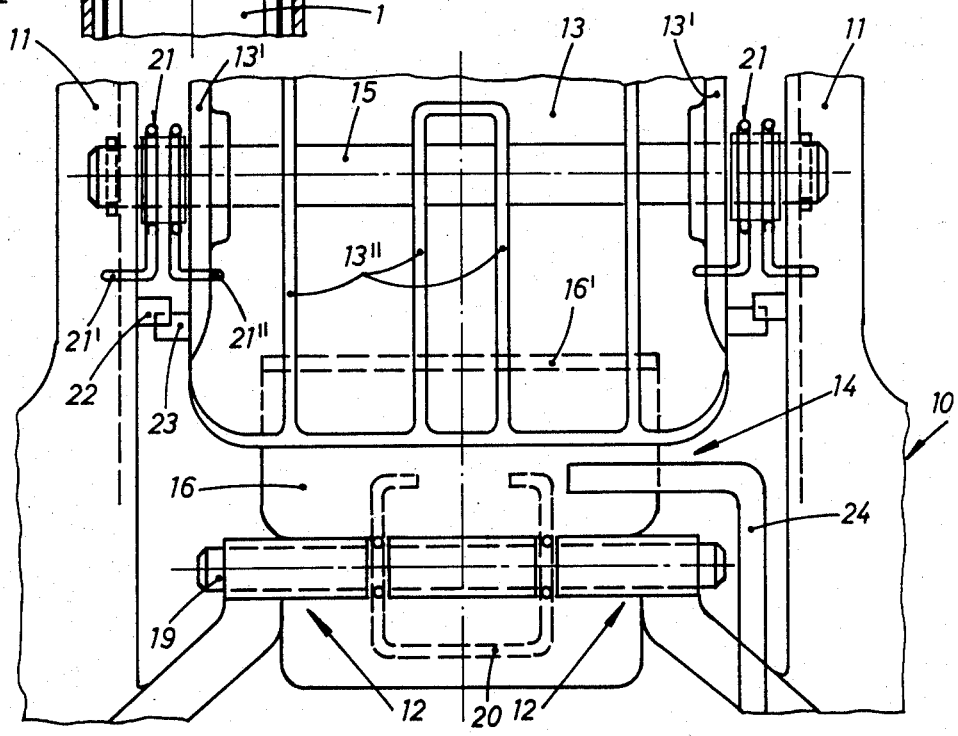

An exemplary embodiment of the subject of the invention is explained below with reference to the drawing in which:

FIG. 1 shows a partial section approximately in the vertical center plane of the seat shell and the back support in the region of articulated connection, and FIG. 2 shows a view as seen in the direction of the arrow "A" in FIG. 1.

In the drawing, 1 denotes the chair column with a vertically adjustable component 2 on which the seat shell 4, together with associated encasing parts 5, is attached via a connecting hub 3. The seat shell 4 is provided, in a way known per se, with upholstery 6 attached to the upholstery support plate 6' and can be provided with an arm-rest, of which only the support 7, by means of which the arm-rest is connected to the seat shell 4, is shown for the sake of simplification. The vertically adjustable component 2 is shown as a pneumatic spring, the control pin 2' of which can be moved from outside the seat shell by an actuating means 9.

Fastened on the inside of the preferably plastic seat shell 4, for example by means of screws (not shown), is a base plate 10 which is appropriately formed from sheet metal and which on the one hand is intended for stiffening the seat shell 4 and supporting the upholstery support plate 6' and on the other hand contains in its rear part bearing elements 11, 12 for receiving in an articulated manner a backrest support 13 of adjustable inclination and its locking arrangement 14.

The backrest support 13, of which the drawing shows only the lower portion, is designed at least in this portion as a bearer stiffened horizontally and vertically. Its middle part and top part can be made sufficiently flexible by means of suitable stiffening to assume, under a load exerted by a user leaning backwards, a longitudinal bending contour which largely matches the natural bending line of the human spinal column in this particular body position. Measures suitable for this purpose, particularly when the backrest support is formed from appropriately flexible plastics, are known. The backrest support is provided, in the same way as the seat shell 4, with upholstery 13.1 which is attached to an upholstery support plate 13.2. Its lower end portion engages into a U-shaped cut-out in the buttock region of the seat shell 4 or respectively side-wall parts 4' of the seat shell 4, the bearing elements 11 of the backrest support mounting also being located in this cut-out.

As already mentioned in the introduction, the possibility of adapting the contour of the backrest support elastically in the way mentioned is limited to certain selected ranges of inclination for reasons of material strength. The total range of inclination which can be covered can therefore be extended substantially by means of preselected basic angles of inclination between the seat rest and the lower, relatively rigid portion of the backrest support 13. It is evident from the drawing that, for this purpose, the backrest support 13 is mounted pivotably on a shaft 15 in the lateral bearing elements 11 of the seat-shell base plate 10. The shaft 15 passes through the bearing elements 11, 12 (and consequently also the side walls 13' and the ribbing 13'' according to FIG. (2) at least at a height equal to the upper limitation of the seat-surface upholstery 16, but preferably at a horizontal distance h of approximately 1–3 cm above the lowest point 6'' of the seat-shell upholstery 6, as emerges from FIG. 1. In this way, it is possible to ensure that in the event of a medium inclination of the backrest there is no noticeable height difference between the upholstery support ends, practically abutting one another, of the seat plate and backrest upholstery 6 and 13.1 respectively and that the buttock-support upholsteries merge essentially continuously into one another.

The backrest support is locked in predetermined inclined positions by a likewise pivotable pawl 16 or respectively its engagement claws 16' engaging into recesses 17 which are provided at the lower end of the backrest support 13 in the wall 18. As shown in FIG. 1, the recesses 17 can simply be formed in the shell-shaped, in any case additionally reinforced wall 18 of the backrest support or can be provided in a separate meshing element attached in or on the wall 18. Helical torsion springs 21, which are attached to the shaft 15 on both sides and the ends of which are supsended respectively in appropriate receiving orifices in the bearing elements 11 or respectively the support side walls 13', give the backrest support 13 an anti-clockwise prestressing force. As a result of this force, the support 13 tends to move into its vertical position (the smallest angle of inclination) when the pawl 16 does not engage into a recess 17 determining a greater angle of inclination. The pivoting range of the backrest support is limited by stop means 22 and 23 respectively which are located on the seat-shell base plate 10 and on the support side wall 13'.

The pawl 16 of the locking arrangement 14 is mounted at its pivoting end 18 on a shaft 19 which is retained at both ends in coiled lugs made from the material of the base plate 10. A torsion bow spring 20, the web part of which is supported on the underside of the base plate 10 and the free ends of which are supported on the underside of the pawl 16, presses the latter in an anti-clockwise direction up against or into engagement with a specific one of the recesses 17 in the end wall 18. By means of an actuating linkage 24 which can be operated from outside the seat shell, the pawl can be disengaged from the particular recess 17 when the backrest is not under load. After the actuating linkage 24 has been released, the pawl 16 runs back in an anti-clockwise direction under the effect of the torsion bow spring 20, until the engagement claw 16' snaps into the recess 17 which is next in the pivoting direction of the backrest support 13.

I claim:

1. A chair with an adjustable backrest support comprising a seat shell rotatably mounted on a chair column, said adjustable backrest support is connected to said seat shell by a fork-shaped bearing, a locking arrangement including an engagement claw for securing a portion of the backrest, the chair further comprising said seat shell having a base plate assembly containing said fork-shaped bearing in the form of symmetric girders projected from a rear part of the chair, said backrest support having an upper part and a lower part, said lower part having a shell shape formed by two side walls and an end wall an external surface of said end-wall having a plurality of transverse recesses therein for engagement with said engagement claw of the locking arrangement providing releasable engagement coupling between the base plate and the end wall of said backrest support for adjusting the tilt of the backrest.

2. A chair according to claim 1 wherein said adjusable backrest support swings forwardly and backwardly within said fork-shaped bearing.

3. A chair according to claim 1 wherein said end wall is positioned substantially perpendicularly to said side walls.

4. A chair according to claim 1 wherein said side walls and end wall define a structure stiffened in the substantially upright and substantially horizontal directions.

* * * * *